US012055359B2

(12) United States Patent
Ralston

(10) Patent No.: US 12,055,359 B2
(45) Date of Patent: Aug. 6, 2024

(54) MULTI-CALIBER SURVIVAL WEAPON PLATFORM SYSTEM FOR REVOLVER/SHOTGUN

(71) Applicant: Loren E. Quest, Jr., Tempe, AZ (US)

(72) Inventor: Timothy Bryan Ralston, Gilbert, AZ (US)

(73) Assignee: Loren E. Quest, Jr., Tempe, AZ (US)

( * ) Notice: Subject to any disclaimer, the term of this patent is extended or adjusted under 35 U.S.C. 154(b) by 0 days.

(21) Appl. No.: 16/567,715

(22) Filed: Sep. 11, 2019

(65) Prior Publication Data

US 2020/0141676 A1 May 7, 2020

Related U.S. Application Data

(60) Provisional application No. 62/729,567, filed on Sep. 11, 2018.

(51) Int. Cl.
*F41A 9/37* (2006.01)
*F41A 9/28* (2006.01)

(52) U.S. Cl.
CPC . *F41A 9/37* (2013.01); *F41A 9/28* (2013.01)

(58) Field of Classification Search
CPC ..... F41A 9/37; F41A 9/28; F41A 9/35; F41A 9/36; F41A 9/27; F41A 21/06; F41A 21/08; F41C 3/14
USPC ..... 42/59–65, 71.02, 73, 69.01; 89/1.41, 89/13.05
See application file for complete search history.

(56) References Cited

U.S. PATENT DOCUMENTS 3,173,221 A * 3/1965 Ivy ..... F41C 3/14 42/65
3,503,300 A * 3/1970 Dardick ..... F41A 21/12 89/33.17
4,285,152 A * 8/1981 Dean ..... F41A 9/47 42/62
4,357,774 A * 11/1982 Badger ..... F41A 21/484 42/59
4,494,332 A * 1/1985 Matievich ..... F41A 21/12 42/59
5,341,587 A * 8/1994 Phillips, Jr. ..... F41A 15/02 42/68
2015/0059223 A1* 3/2015 Ralston ..... F41A 9/28 42/59

OTHER PUBLICATIONS

NPL: https://historical.ha.com/itm/handguns/unmarked-unique-single-action-percussion-pepperbox-revolver/a/6099-32074.s 2013.*
NPL: https://www.tumgir.com/tag/pepperbox%20pistol.*

* cited by examiner

*Primary Examiner* — John Cooper
(74) *Attorney, Agent, or Firm* — Bennet K. Langlotz; Langlotz Patent & Trademark Works, LLC

(57) ABSTRACT

A firearm is provided comprising a frame which defines a forward aperture. A cylinder is mounted rotatably to the frame to rotate on a cylinder axis. The cylinder defines a plurality of passages each at a common radius from the axis, each passage includes a chamber and a rifled bore. At least one of the passages is being chambered for a different caliber than at least one other of the passages.

1 Claim, 7 Drawing Sheets

MULTI-CALIBER SURVIVAL WEAPON PLATFORM SYSTEM FOR REVOLVER/SHOTGUN

CROSS-REFERENCE TO RELATED APPLICATIONS

This application claims the benefit of U.S. Provisional Patent Application No. 62/729,567, filed on Sep. 11, 2018, entitled "Multi-Caliber Survival Weapon Platform System for Revolver/shotgun", which is hereby incorporated by reference in its entirety for all that is taught and disclosed therein.

FIELD OF THE INVENTION

The present invention relates to firearm which comprises a frame defining a forward aperture with a cylinder rotatably mounted to the frame to rotate on a cylinder axis

DETAILED DESCRIPTION OF A PREFERRED EMBODIMENT

Figure 1:
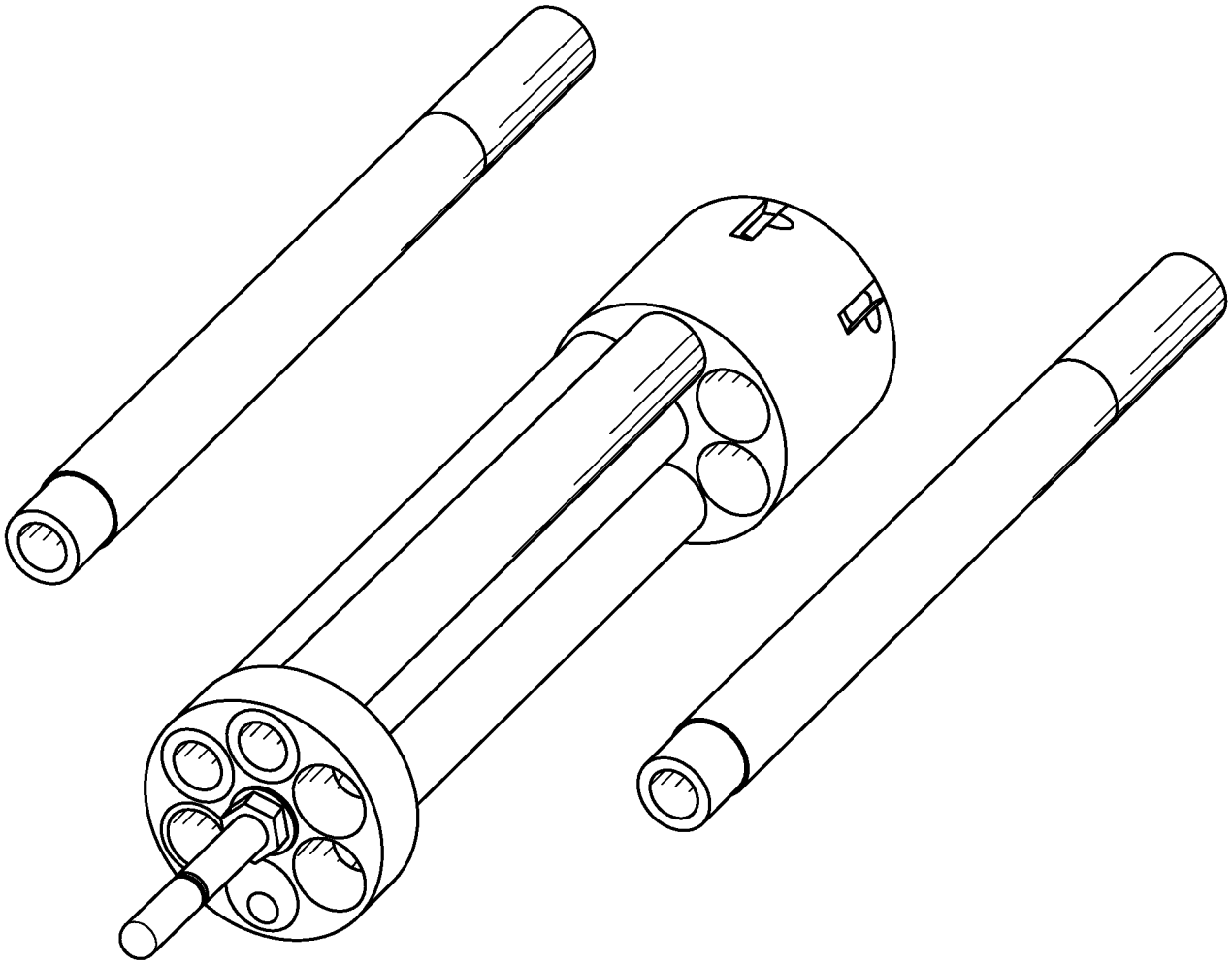
FIGS. 1-7 show various views of a preferred embodiment of the invention.

FIG. 1 illustrates CB (cylinder Barrel) Tubes.

Figure 2:
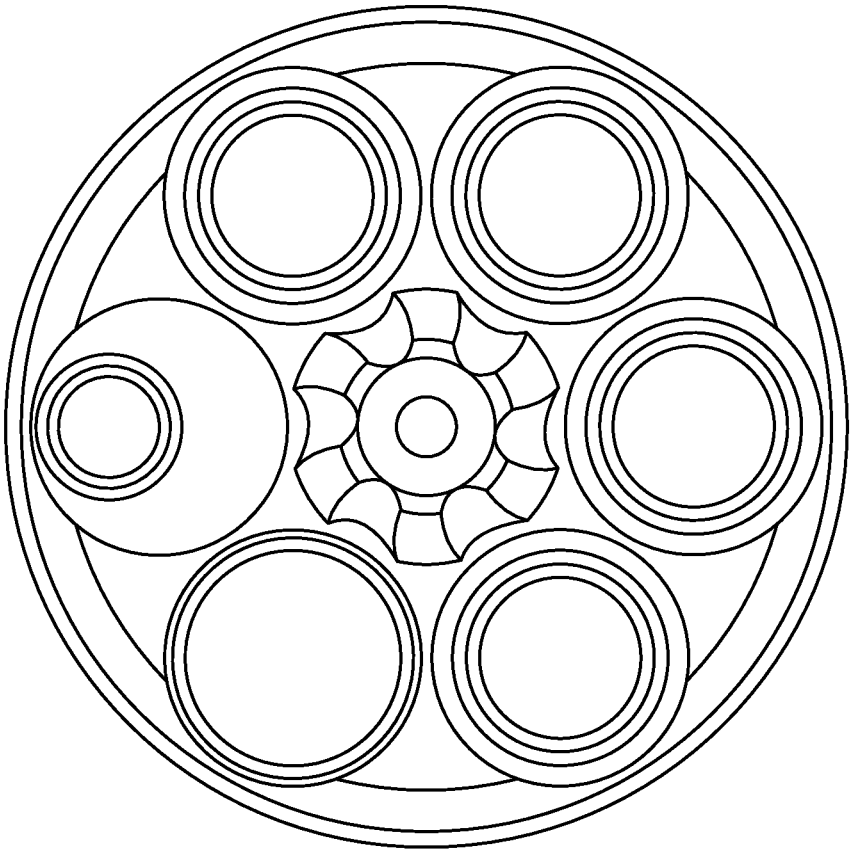

FIG. 2 is a rear view of the CB Tube assembly showing multi-caliber choses.

Figure 3:
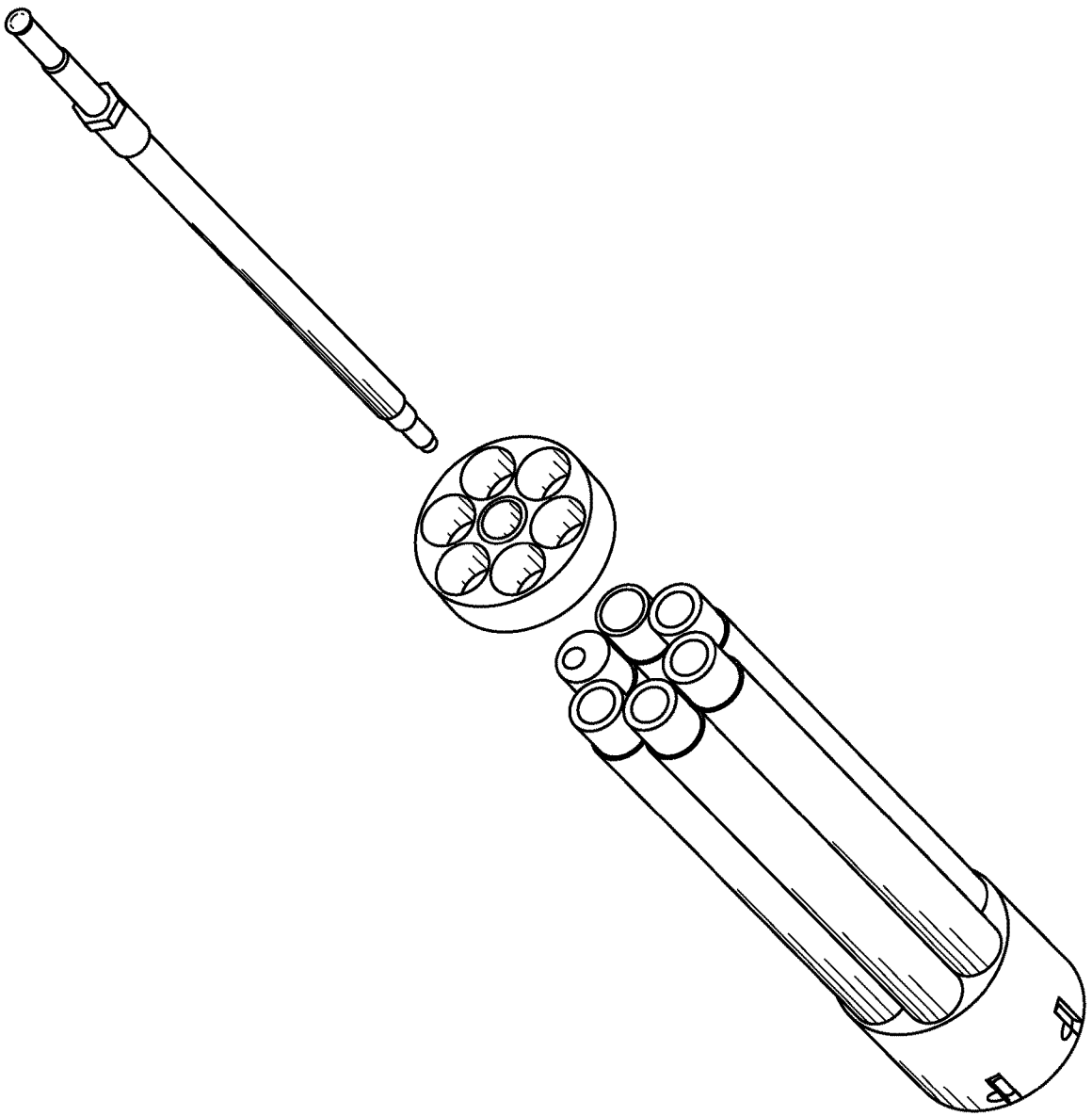

FIG. 3 shows a CB tube locking rod bar.

Figure 4:
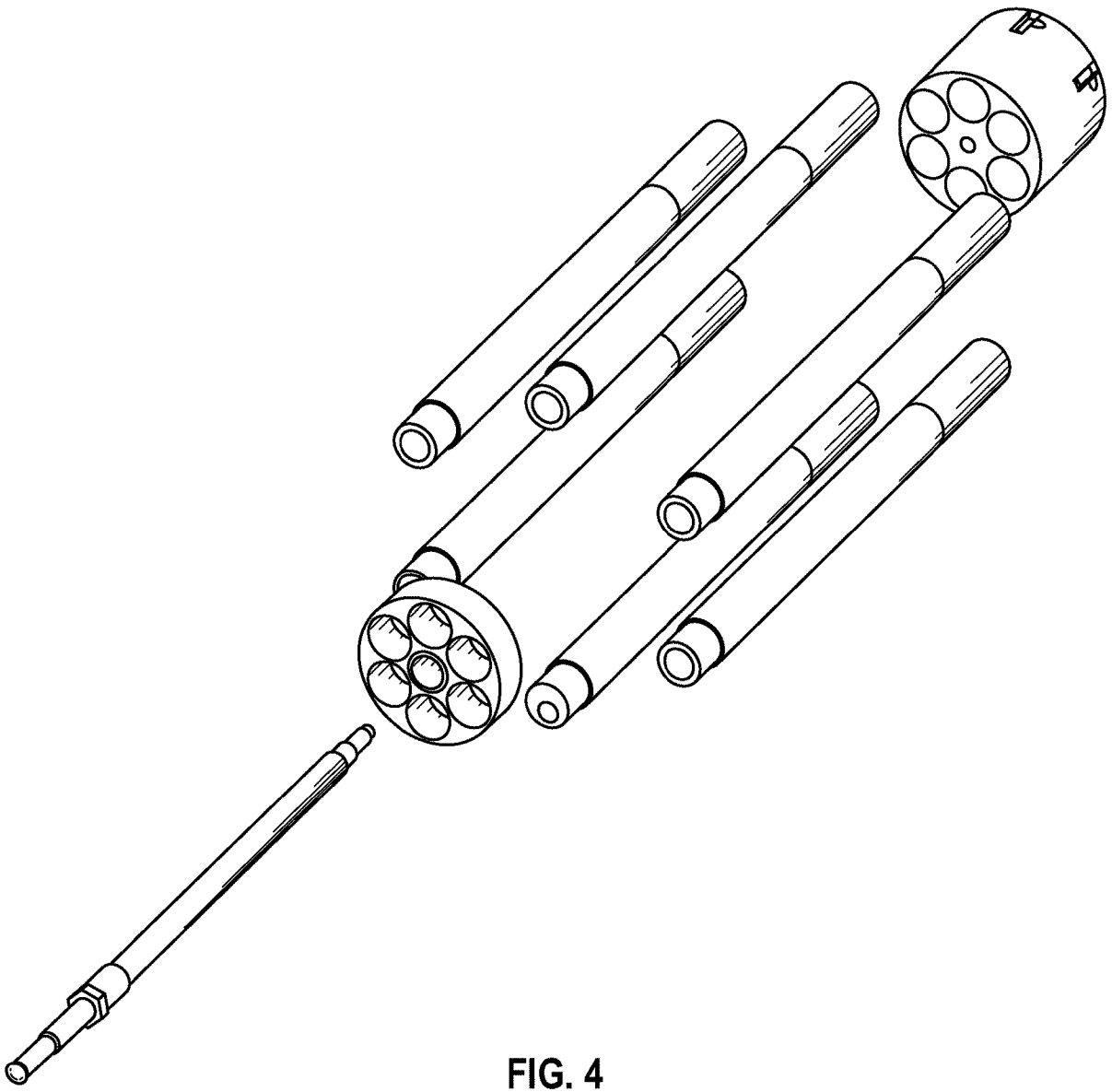

FIG. 4 shows a CB Tube, tube selection and easy assembly of your choice of caliber from .22-.223 caliber.

Figure 5:
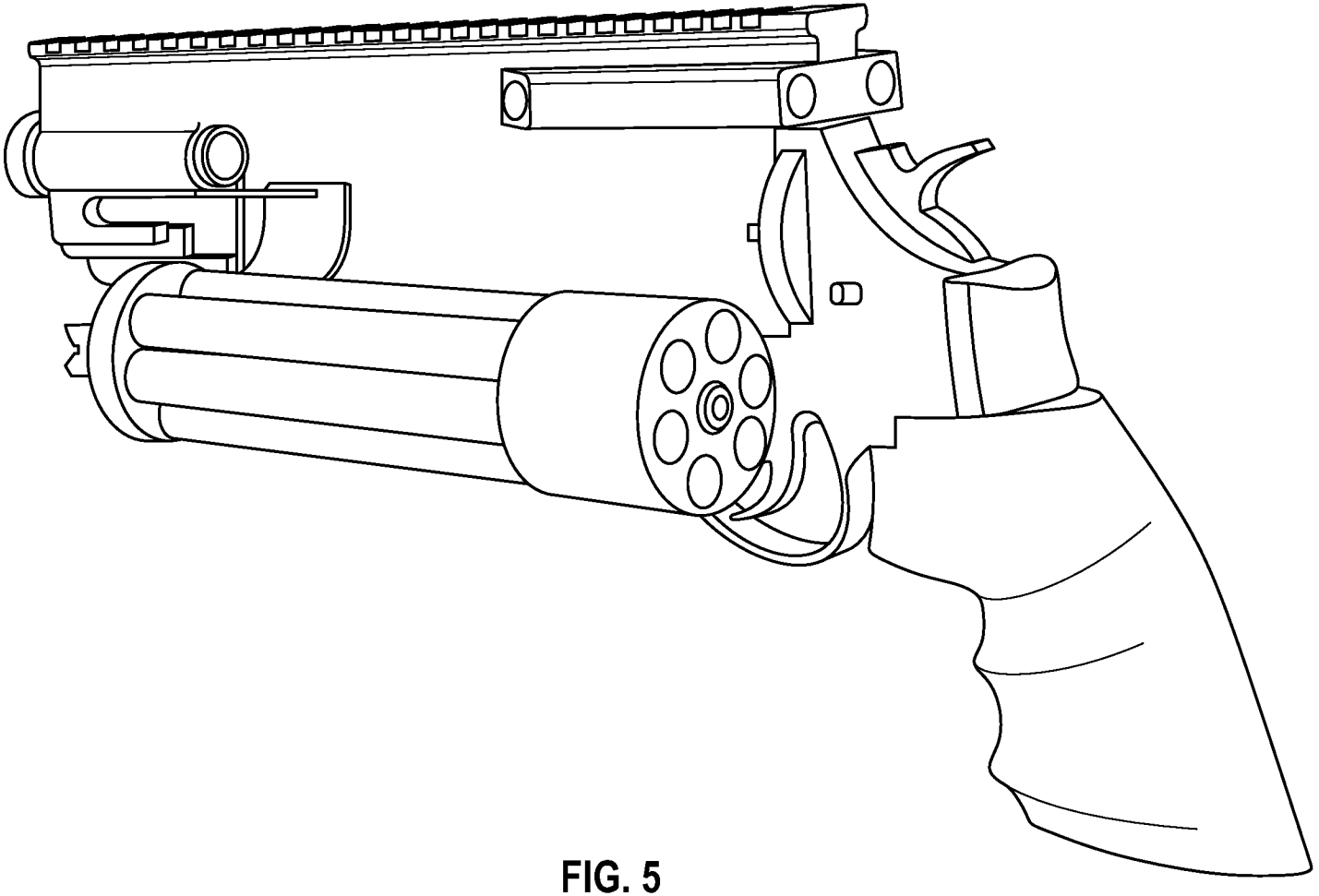

FIG. 5 illustrates the Scavenger 6 CB opened for reloading.

Figure 6:
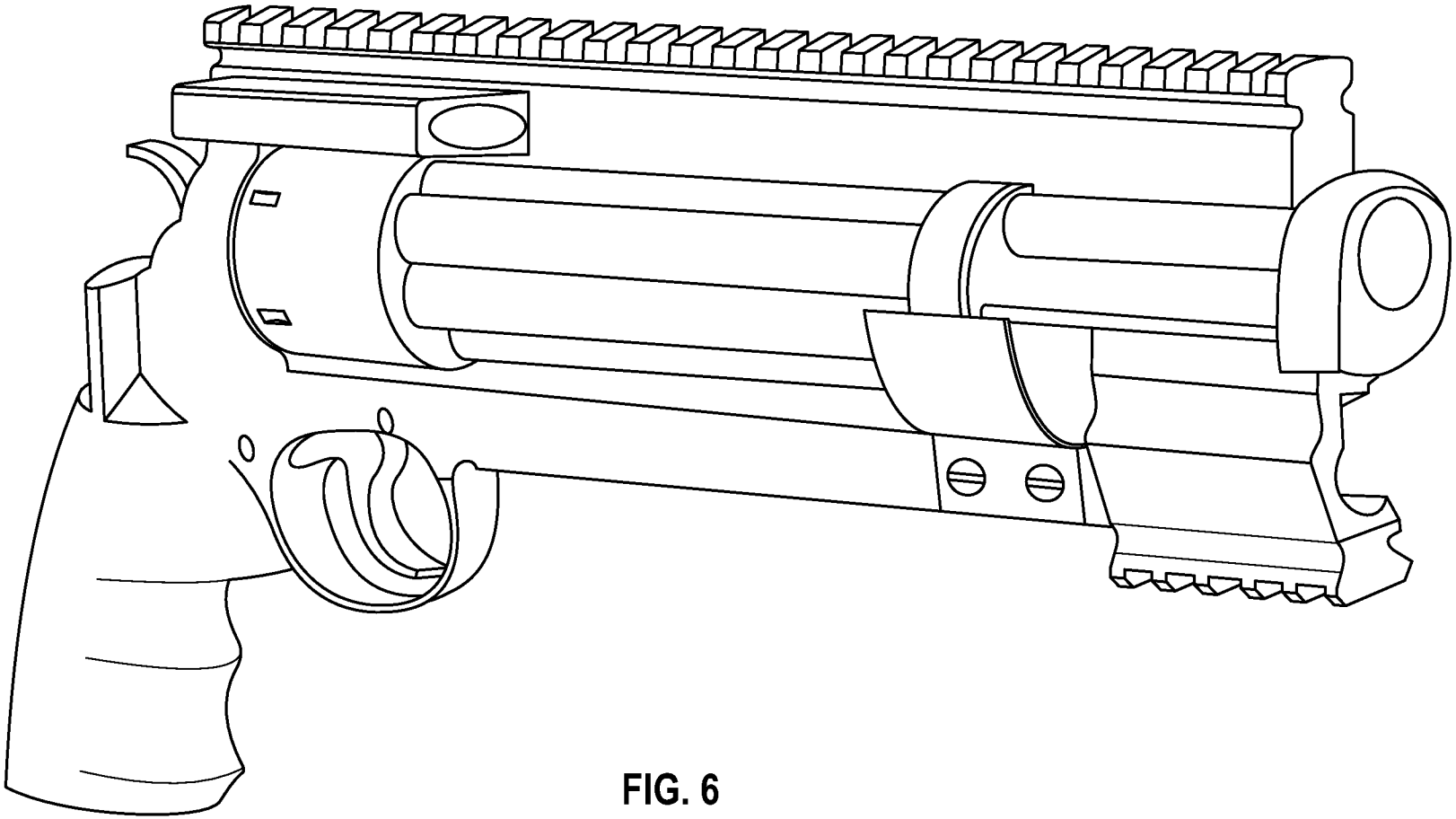

FIG. 6 illustrates the Scavenger 6 ready for shooting.

Figure 7:
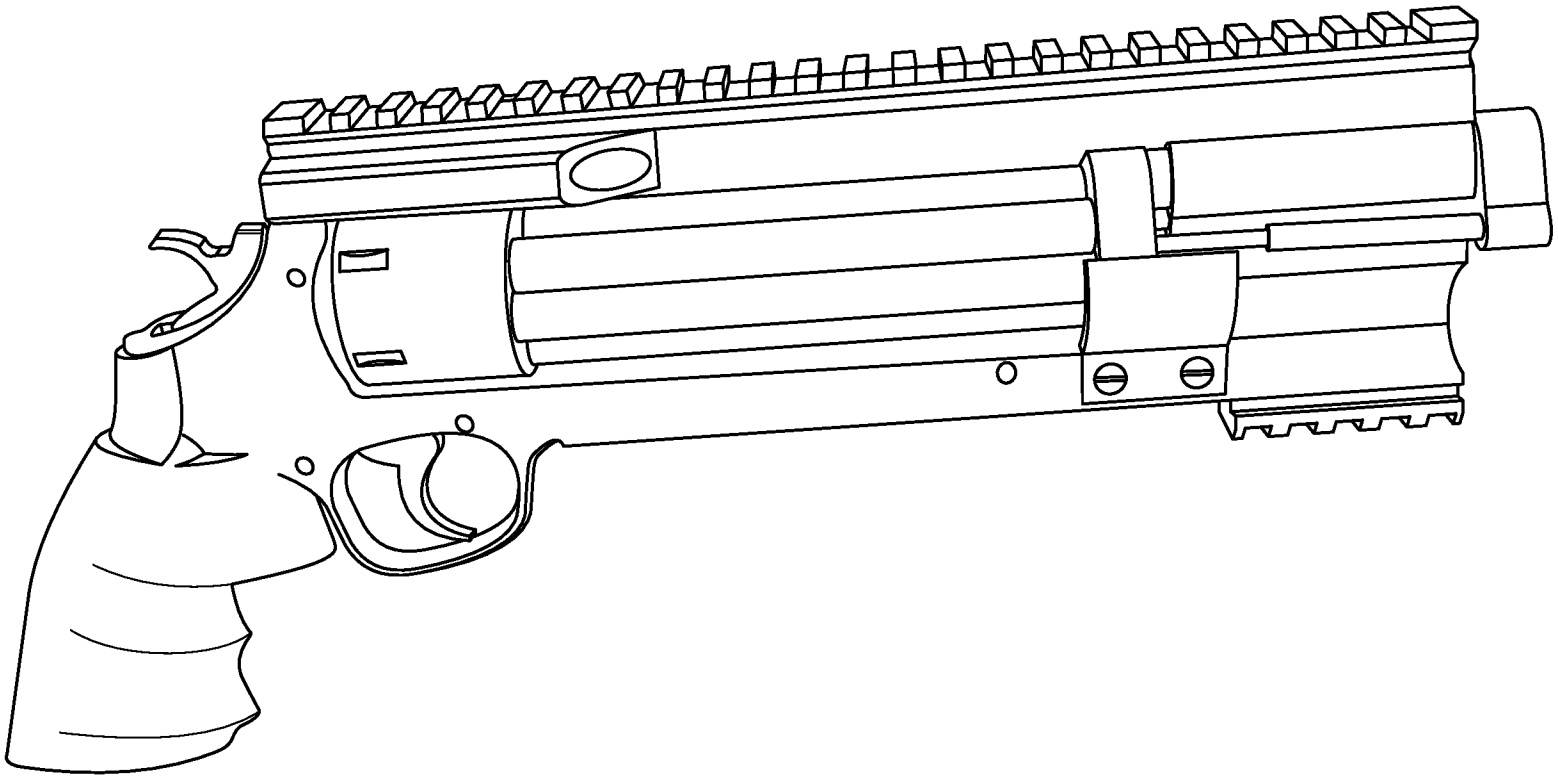

FIG. 7 is a side view of the Scavenger 6 with the picatinny rails on top and bottom of frame.

The Scavenger 6 plate form will have different sets of CB'S (cylinder Barrels).

The Big Bore CB is the CB that is chambered in the larger, higher pressure calibers everything from a 5.56 up to .308 and everything in between. The Cb will be chambered with six shots in the same caliber. The Cb will be 7 inches of rifled Hardened steel barrel material, fully rifled for accuracy.

CB Tubes is the CB that are a single shot barrel that will nest in a CB cradle that holds 6 CB Tube. The user can customize the caliber that the cradle will hold. The cradle will hold 6 CB Tubes. Those calibers are from .17 up to .223 and everything in between. The tubes can be changed in the field with no tools and exchanged in less than 1 min.

The Multi-Caliber Survival Weapon Platform System (referred to as the CB) allows the shooter to exchange the "CB's" and the ammunition they are shooting to adapt to their circumstances in just seconds. The CB's are lightweight, compact and rifled 7 inches to increase the accuracy.

To exchange the CB's the shooter simply presses a button located on the weapon system's frame. The company will initially offer three multi-caliber CBs: The Survival CB, which shoots 8 different calibers, the Hunter CB, which shoots 7 different calibers, and the Battle CB, which shoots 6 different calibers, making it the most diverse weapons platform available on the market. Additional multi-shot single caliber CBs will also be available for purchase. With the wide array of combinations, the shooter can shoot their favorite caliber ammunition, use the multiple CB, or adapt the weapon system to any situation.

According to inventor Tim Ralston, "This patented weapons platform is the most versatile weapon that has ever existed and will be the choice for those looking for a diverse firearm."

"American Spirit Arms is proud to be chosen as the manufacturer of The Scavenger 6", said Rob Dunaway, President of ASA. We pride ourselves on precision machining work that showcases our 15 years of aerospace and firearms manufacturing experience.

Tim Ralston and Ralston Armory have introduced another exciting design for the industry."

American Spirit Arms is a manufacturer of precision built, highly accurate and reliable AR15, .308 AR, M-16 and M4 firearms and firearm components.

While in its last stages of research and development, a sneak preview of The Scavenger 6 will be available at the American Spirit Arms booth (#2736) during the Shooting, Hunting, Outdoor Tradeshow ("SHOT Show"), Jan. 19-24, 2016 at the Sands Expo and Convention Center, in Las Vegas. The conference is the largest and most comprehensive trade show for all professionals involved with the shooting sports, hunting and law enforcement industries.

It is the world's premier exposition of combined firearms, ammunition, law enforcement, cutlery, outdoor apparel, optics and related products and services.

Related products include the New X Caliber Gauge Adapter system which is the most versatile Adapter system in the world. It allows you to shoot 10 different caliber rounds from one shooting platform: a single-shot, an over/under or side by side smooth-bore 12 gauge. Each X Caliber gauge adapter is made from 7 inches of Blued Stainless Steel. The multi-caliber gauge adapters are also fully rifled to increase accuracy (20 gauge is smooth-bore).

The calibers of ammunition that the X Caliber can fire include: 38 special/.357/9 mm/45 acp/45LC/.410 shotgun/.380/.40 cal/.44 mag/20 ga shotgun.

The shotgun adapter inserts are easily stored in a heavy-duty canvas case complete with MOLLE-compatible straps on the backside for easy mounting on your bug out pack. The X Caliber truly gives you options. You choose the right caliber for the task at hand. The X Caliber equals ten guns for the price of one, saving you money, and reducing weight in your pack. X Caliber gives you ten guns for the price of one, and the survival value is priceless.

I claim:

1. A firearm comprising:

a frame;

the frame defining a forward aperture;

a plurality of elongated cylinders rotatably mounted to the frame to rotate on a common cylinder axis;

the cylinders each connected at their ends, and separate at intermediate portions;

the plurality of cylinders each defining a passage, each at a common radius from the common cylinder axis;

each of the passages including a chamber and a rifled bore;

each of the passages being interchangeable within the cylinders;

at least one of the passages being chambered for a different caliber than at least one other of the passages; and wherein the calibers range in size from to 0.2 inch to 0.308 inch and 0.17 inch to 0.223 inch.

* * * * *